United States Patent [19]

Pears

[11] 4,090,586

[45] May 23, 1978

[54] LADDER STABILIZER

[75] Inventor: Roy A. Pears, Reno, Nev.

[73] Assignee: The Raymond Lee Organization, Inc., New York, N.Y.

[21] Appl. No.: 786,269

[22] Filed: Apr. 11, 1977

[51] Int. Cl.[2] ..... E06C 7/44

[52] U.S. Cl. ..... 182/204

[58] Field of Search ..... 182/204, 201

[56] References Cited

U.S. PATENT DOCUMENTS

| | | | |
|---|---|---|---|
| 891,965 | 6/1908 | Thomas | 182/201 |
| 4,029,174 | 6/1977 | Planck | 182/204 |

FOREIGN PATENT DOCUMENTS

| | | | |
|---|---|---|---|
| 10,852 | 5/1910 | United Kingdom | 182/201 |
| 836,612 | 6/1960 | United Kingdom | 182/204 |

*Primary Examiner*—Reinaldo P. Machado

*Attorney, Agent, or Firm*—Howard I. Podell

[57] ABSTRACT

A ladder fitted with a detachable foot section that can be fastened to either lower leg section of the ladder for extending the length of the fastened leg section. The detachable foot section is in the form of a circular housing threadably engaged to a screw that extends through both top and bottom ends of the housing, with projecting clip members externally fixed to the housing that engage shaped holes in the lower terminal section of the ladder leg.

2 Claims, 5 Drawing Figures

LADDER STABILIZER

SUMMARY OF THE INVENTION

My invention is a ladder fitted with a detachable foot section that can be fastened to either lower leg section of the ladder for extending the length of the fastened leg section. The detachable foot section is in the form of a circular housing threadably engaged to a screw that extends through both top and bottom ends of the housing, with projecting clip members externally fixed to the housing that engage shaped holes in the lower terminal section of the ladder leg.

BRIEF DESCRIPTION OF THE DRAWINGS

The objects and features of the invention may be understood with reference to the following detailed description of an illustrative embodiment of the invention, taken together with the accompanying drawings in which.

DESCRIPTION OF THE PREFERRED EMBODIMENT

Figure 1:
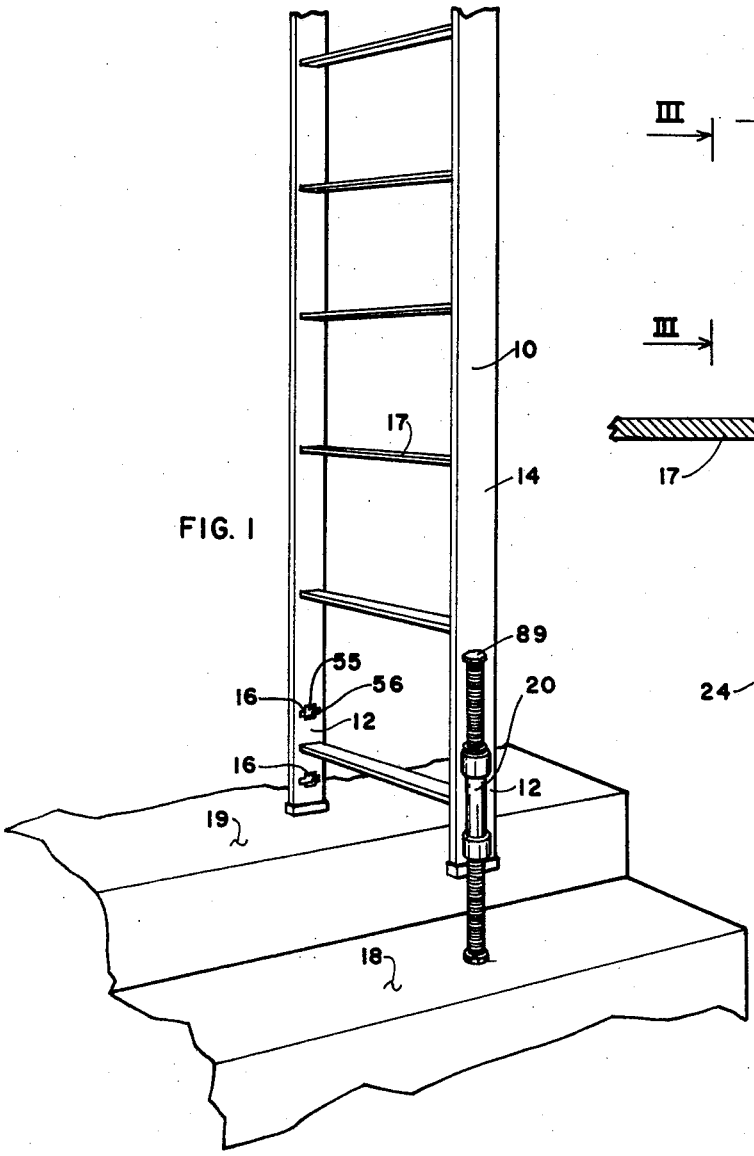
FIG. 1 is a perspective view of the invention in use.
Figure 2:
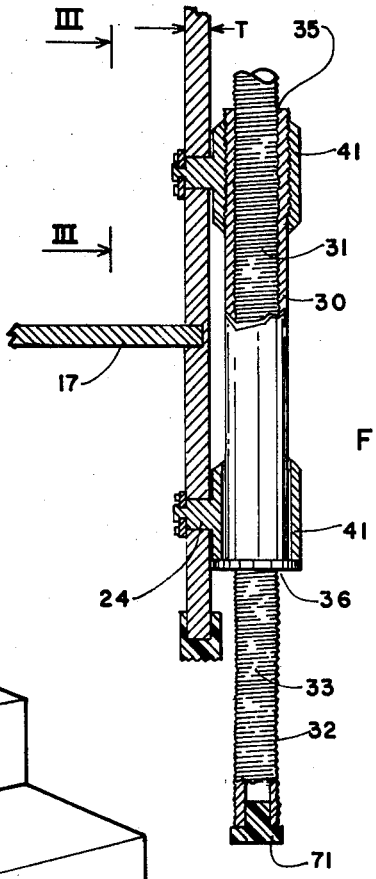
FIG. 2 is a sectional detail view of the invention.
Figure 3:
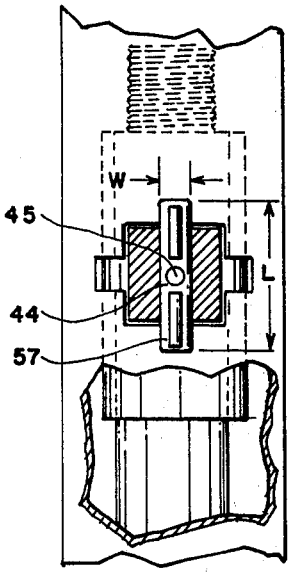
FIG. 3 is a sectional view of the invention, taken along line 3—3 of FIG. 2.

Turning now descriptively to the drawings, in which similar reference characters denote similar elements throughout the several views, FIGS. 1–3 illustrate the ladder 10 with detachable foot section 20 fastened to the lower terminal section 12 of one leg 14 member of the ladder by means of brackets 24 that fit through shaped spaced holes 16 in leg section 12 so that the attached foot section 20 can support the leg 14 to which it is attached when resting on a surface 18 lower than the surface 19 on which the other ladder leg 14 rests, while maintaining both ladder legs 14 along vertical axes and maintaining ladder rails 17 in a horizontal plane. The extension distance of the bottom of foot section 20 may be adjusted with regard to the bottom of the attached ladder leg.

Foot section 20 includes a tubular housing 30 formed with a female thread along its inner tubular wall that engages a male screw thread 32 of a tubular support rod 33 that extends through the top and bottom ends 35, 36 respectively of housing 30. Two collars 41 are externally fixed to housing 30 in spaced relation, with each collar 41 fitted with a radially projecting bracket 24 of rectangular cross-section that extends from the collar 41 by a distance equal generally to the thickness T of the ladder leg 14. A rectangular clip 44 is rotatably fastened by a pin 45 to the end surface 46 of each bracket 24, with clip 44 being of a length L that is greater than vertical height H of bracket 24 and of a width W less than said height H.

Holes 16 are each shaped with a central rectangular section 55 of a size to detachably fit about bracket 24, with a groove 56 extending horizontally from each side of central section 55 of a shape to clear a projecting end section 57 of clip 44 when clip 44 is oriented perpendicular to the vertical axis of leg 14. Rotation of clip 44, after bracket 24 is engaged in hole 16 serves to clamp bracket 14 and housing collar 41 to the attached leg 14.

Figure 4:
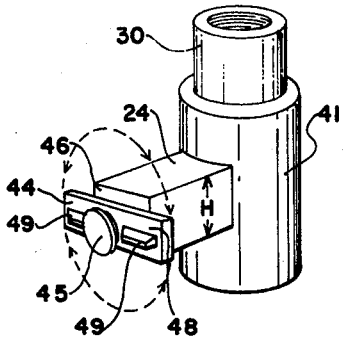
FIG. 4 is a detail perspective view of a housing sleeve and bracket.

Finger grip extensions 49 externally mounted to the external end face 48 of clip 44 serve as means to manually grip clip 44 for rotation to either the vertical fastening position shown in FIG. 3 or the horizontal position shown in FIG. 4 for loosening the clip and bracket from the ladder leg.

Figure 5:
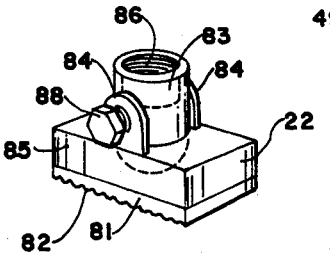
FIG. 5 is a perspective view of an attachable foot rest.

The upper end of rod 33 is formed as a hexagon shaped head 89. A detachable plastic foot pad 71 may be fixed to the lower end of the support rod 33 or alternately a pivotal foot pad 80 shown in FIG. 5 may be threaded to the lower end of the support rod. Foot pad 80 is formed of a plastic block 81 formed with a corrugated undersurface 82 with block 81 fixed to a metal block 85 to which a collar 83 is pivotally mounted to projecting tabs 84 by bolts 88 with collar 83 formed with a female thread 86 of a size to engage the male thread 32 of support rod 33 when foot pad 71 is removed and collar 83 is threaded to rod 33.

With foot pad unit 80 threaded to rod 33, the two legs of ladder 10 may rest on two surfaces of different heights and different inclinations, since collar 83 when threaded to rod 33 may be rotated so that undersurface 81 may rest flat on a surface inclined at an angle other than 90° to rod 33. Rotation of rod 33 with regard to housing 30 varies the extended length of the bottom end of rod 33 below the bottom end of rod 33 below the bottom end of ladder leg 14.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A ladder fitted with means to detachably fasten a leg support unit to either lower leg section of the ladder, said leg support unit fitted with means to regulate the distance from the bottom end of the leg support unit to the points of fastening of the unit to the ladder leg, in which the leg support unit is formed of a housing threaded to a support rod that extends through the lower end of said housing, with the housing fitted with a pair of spaced shaped brackets, each projecting from a common side of the housing, and in which each lower leg section of the ladder is formed with a pair of spaced through holes, each said hole being of a size to fit about a said bracket, with each bracket extending from the housing by a length not less than the thickness of a ladder leg in the direction of the axis of a said hole, with a clip member rotatably mounted to the end of each bracket and of a size to extend beyond the profile of the bracket, with each said hole in a ladder leg section formed with at least one radial groove of a size to freely fit about the clip member of the bracket, such that the bracket may be fitted into a said hole when the clip member is aligned with the said groove, but that the said bracket may not then be disengaged from the ladder leg section when the clip member is rotated to a position in which it is not aligned with the said groove.

2. The combination as recited in claim 1 in which each said hole is of a non-circular cross-section and each bracket is formed with a non-circular cross-section of a shape so as to engage a said non-circular hole in non-rotatable engagement, when a said bracket is engaged in a said hole.

* * * * *

UNITED STATES PATENT OFFICE

CERTIFICATE OF CORRECTION

Patent No. 4,090,586 Dated May 23, 1978

Inventor(s) Roy A. Pears

It is certified that error appears in the above-identified patent and that said Letters Patent are hereby corrected as shown below:

Cover Page, col. 2, last line:

Change "2 Claims, No Drawings" to read

-- 2 Claims, 5 Drawings Figures --.

Signed and Sealed this

*Twenty-first* Day of *November 1978*

[SEAL]

*Attest:*

RUTH C. MASON
*Attesting Officer*

DONALD W. BANNER
*Commissioner of Patents and Trademarks*